US011771934B2

(12) United States Patent
Freeman

(10) Patent No.: US 11,771,934 B2
(45) Date of Patent: Oct. 3, 2023

(54) FIRE-SAFETY DEVICE AND SYSTEM

(71) Applicant: Kenneth Freeman, Warwickshire (GB)

(72) Inventor: Kenneth Freeman, Warwickshire (GB)

( * ) Notice: Subject to any disclaimer, the term of this patent is extended or adjusted under 35 U.S.C. 154(b) by 257 days.

(21) Appl. No.: 16/981,911

(22) PCT Filed: Apr. 9, 2019

(86) PCT No.: PCT/GB2019/051033
§ 371 (c)(1),
(2) Date: Sep. 17, 2020

(87) PCT Pub. No.: WO2019/197821
PCT Pub. Date: Oct. 17, 2019

(65) Prior Publication Data

US 2021/0101035 A1 Apr. 8, 2021

(30) Foreign Application Priority Data

Apr. 12, 2018 (GB) ..... 1806040

(51) Int. Cl.
*A62C 3/16* (2006.01)
*A62C 37/38* (2006.01)
*A62C 99/00* (2010.01)

(52) U.S. Cl.
CPC ..... *A62C 3/16* (2013.01); *A62C 37/38* (2013.01); *A62C 99/0018* (2013.01)

(58) Field of Classification Search
CPC A62C 35/11; A62C 35/13; A62C 3/16; A62C 37/38; A62C 99/0018; A62C 3/00;
(Continued)

(56) References Cited

U.S. PATENT DOCUMENTS 5,123,490 A 6/1992 Jenne
5,936,531 A 8/1999 Powers
(Continued)

FOREIGN PATENT DOCUMENTS

CN 205680934 U 11/2016
KR 101170083 B1 7/2012
(Continued)

OTHER PUBLICATIONS

International Search Report and Written Opinion for corresponding PCT application No. PCT/GB2019/051033, dated Sep. 13, 2019.

*Primary Examiner* — Christopher R Dandridge
(74) *Attorney, Agent, or Firm* — Notaro, Michalos & Zaccaria P.C.

(57) ABSTRACT

An electrical device having a housing containing at least one electrical component and an automatic fire prevention or extinguishing system with at least one heat and/or smoke sensor, the at least one heat and/or smoke sensor is operably connected to a container holding a fire-retarding, fire-extinguishing or fire-prevention material and the container is arranged to dispense the fire-retarding, fire-extinguishing or fire-prevention material into the housing and/or onto the electrical component when the at least one heat and/or smoke sensor detects heat and/or smoke inside the housing, as the fire-retarding, fire-extinguishing or fire-prevention material is dispensed through at least one conduit operably connected to the container holding the fire-retarding, fire-extinguishing or fire-prevention material. Each conduit is arranged to track electrical wiring of the electrical device or track at least part of an outer surface of at least one electrical component of the device.

17 Claims, 12 Drawing Sheets

(58) Field of Classification Search
CPC ..... A62C 37/40; A62C 37/36; A62C 37/44; A62C 2/065; A62C 35/10; A62C 31/28
See application file for complete search history.

(56) References Cited

U.S. PATENT DOCUMENTS

| | | | | |
|---|---|---|---|---|
| 2004/0216895 | A1* | 11/2004 | Boyce | A62C 3/16 169/61 |
| 2009/0188682 | A1 | 7/2009 | Gensel et al. | |
| 2017/0345527 | A1* | 11/2017 | Royston | H02G 3/0481 |
| 2018/0050230 | A1* | 2/2018 | Toland | A62C 3/16 |

FOREIGN PATENT DOCUMENTS

| | | | | |
|---|---|---|---|---|
| SE | WO2017146629 | * | 8/2017 | A62C 3/16 |
| WO | 2009022838 | A2 | 2/2009 | |
| WO | 2017146629 | A1 | 8/2017 | |

* cited by examiner

FIRE-SAFETY DEVICE AND SYSTEM

TECHNICAL FIELD OF THE INVENTION

The present invention relates to fire-safety devices and systems, and in particular automatic fire-safety devices and systems capable of detecting and automatically extinguishing, controlling or preventing an electrical fire or potential electrical fire at its source.

BACKGROUND TO THE INVENTION

It is known to use a fire-detecting device, such as a smoke detector, to detect a fire in a room or building and alert people in the immediate vicinity. It is also known to couple such devices to fire-extinguishing systems that are activated by the fire-detecting device in the event of a fire. Such systems include sprinkler systems, whereby water is sprayed/deposited onto a fire within the room or building.

Known systems may fail to activate until a fire has already begun to spread, as sufficient levels of heat/smoke must be generated/detected in order to trigger the alarm. Therefore, these systems are only useful for fires that have already begun to propagate and cannot be used to prevent potential fires that are yet to start. These systems also may not put out a spreading fire efficiently, as the extinguishing system must operate over a large area, and thus they do not concentrate solely on the affected area.

Many fires are commonly caused by a fault in an electrical component or device. So-called "electrical fires" generally give off small amounts of smoke and heat before igniting and spreading to surrounding material, thus leading to a full-blown fire. Such signals of an impending electrical fire cannot be detected early by known systems and so fires caused by electrical fires or faults can generally only be detected by known systems when they have developed into full-blown fires, which in many cases may already have spread far beyond the electrical component or device. Known systems are therefore also not useful in detecting the early warning signs (small amounts of heat and/or smoke) of an electrical fire.

There is therefore a need to provide an automatic fire-safety device or system that can detect a very small fire or the beginnings of a fire, and can efficiently extinguish or prevent it before it spreads.

There is also a need to provide an automatic fire-safety device or system that can detect the pre-fire signs (such as small amounts of heat and smoke) of, and prevent, an electrical fire at its source, before it can start, and/or to detect an electrical fire and extinguish it quickly and efficiently at the source.

A self-contained smoke actuated extinguishing system is described in U.S. Pat. No. 5,123,490. This system relies on flooding an area with a fire-control material which is released from a single dispensing point, in order to extinguish a fire. This has the disadvantage that the fire-control material may not be able to reach all parts and/or critical points of a device/appliance in which the system is located, or may not be able to reach all parts and/or critical parts of the device/appliance (which could be the source of the fire) quickly enough for efficient prevention and/or extinguishing of a fire or potential fire.

It would therefore be advantageous to provide an automatic fire-safety device or system that can dispense fire-control material into multiple locations within a housing and/or device/appliance, and/or can dispense fire-control material into hard-to-reach/physically restricted areas within a device/appliance, such that the fire-control material can reach critical areas within the device/appliance, and/or can reach a large internal volume, or substantially the whole internal volume, of a device/appliance.

It is therefore an aim of one or more embodiments of the invention to overcome or mitigate at least one problem of the prior art.

SUMMARY OF THE INVENTION

According to a first aspect of the invention there is provided an electrical device comprising a housing containing at least one electrical component and an automatic fire prevention or extinguishing system comprising at least one heat and/or smoke sensor, wherein the at least one heat and/or smoke sensor is operably connected to a container holding a fire-retarding, fire-extinguishing or fire-prevention material and wherein the container is arranged to dispense the fire-retarding, fire-extinguishing or fire-prevention material into the housing and/or onto the electrical component when the at least one heat and/or smoke sensor detects heat and/or smoke inside the housing, wherein the fire-retarding, fire-extinguishing or fire-prevention material is dispensed through at least one conduit operably connected to the container holding the fire-retarding, fire-extinguishing or fire-prevention material, and wherein the or each conduit is arranged to track electrical wiring of the electrical device or track at least part of an outer surface of at least one electrical component of the device.

Hereinafter fire-retarding, fire-extinguishing and fire-prevention materials may be collectively named "fire-control materials". For the purposes of this invention the term "electrical device" includes, but is not limited to, electronic devices and also devices and apparatus used in the transport, storage and distribution of electricity (domestically or industrially), as well as household appliances.

In some embodiments the container holding the fire-control material is located inside the housing. In such embodiments, the container may be arranged to release, dispense or spray the fire-control material into the housing directly upon actuation. This may allow the fire-control material to extinguish the fire extremely quickly after it is detected, or to reduce the heat generated by the electrical component before the component catches fire or causes a fire.

The container may dispense/release the fire-control material through a release valve, wherein the valve is activated upon receipt of a signal from the at least one heat and/or smoke sensor. Alternatively, or additionally, the container may be arranged to rupture or explode upon a signal from the at least one smoke and/or heat detector, thus releasing its whole contents very rapidly. In preferred embodiments where the container is located inside the housing, the container may rupture or explode due to activation of an ignition system operably connected to the container, by the at least one smoke and/or heat sensor. The container may rupture and/or explode in response to a signal from a signaling system. The container holding the fire-control material may be replaceable or refillable. The container may be rigid or flexible. A flexible container is particularly suitable for embodiments in which the container is required to fit into an awkwardly-shaped housing or is required to be retro-fitted into an existing electrical device or appliance or an existing fixed electrical component housing. The container may comprise a canister, bag or a sack. The number of containers may be at least 1, at least 2, at least 3, at least 4, at least 5 or at least 10. In some embodiments there may be a container located adjacent to two or more sides of the electrical component within the housing.

There may be two or more conduits, which may be independently operably connected to one or more outlets on the or each container. The at least one conduit may extend from the container to a plurality of or all areas or regions of a device and/or to a plurality of or all important/critical areas of a device and/or to all desired areas of a device. The at least one conduit may extend at least partly around the interior and/or exterior of a device and/or the at least one electrical component. The at least one conduit may extend at least partly around one or more interior walls of the housing of the device. In some embodiments, there may be multiple conduits connected to the same container and/or different containers. The at least one conduit may have a branched structure. In some embodiments there may be a conduit network formed from the at least one conduit. The conduit network may comprise a single branched or unbranched conduit. The conduit network may comprise more than one branched or unbranched conduit.

The fire-control material may be dispensed through at least one aperture positioned along the length of the at least one conduit and/or out of at least one terminal end of the at least one conduit. The at least one conduit may have a plurality of apertures positioned along its length. The at least one conduit may have apertures positioned along substantially the whole of its length or along a portion or multiple portions of its length, and each portion may be separated from other portions by a length comprising no apertures. The at least one aperture may comprise perforations and/or nozzles. The at least one conduit may comprise at least one needle and/or pipe. The at least one needle and/or pipe may comprise at least one perforation positioned along at least a portion of its/their length. The at least one conduit may have multiple apertures configured to enable dispensing of fire-control material along the whole length of said at least one conduit substantially simultaneously. In some embodiments, the conduits may comprise a nozzle means at the at least one terminal end of the at least one conduit. The at least one conduit may be arranged to dispense fire-control material at multiple locations within the housing and/or device. The at least one conduit may comprise one or more apertures at or proximal to the location of at least one electrical component and/or electrical connecting point within the housing and/or the device. For example, the at least one conduit may comprise one or more apertures at or proximal to a connection point between one or more wires and at least one electrical component of the device.

The at least one conduit may be flexible and/or deformable. The at least one conduit may be flexible and/or deformable so as to be easily fitted or retrofitted into a device. In some embodiments, the at least one conduit comprises flexible and/or inflexible tubing, which may be polymeric or metal tubing. The at least one conduit may follow the wiring or component into one, several or all electrical connection points, for example an electrical connecting block, to which the wiring may be connected. There may be at least one conduit associated with all electrical wires or components in the device, or associated with at least one electrical wire or component. In some embodiments, the conduits may extend through a housing containing electrical wires, such as a wiring loom. The term "wiring loom" includes or is synonymous with cable harnesses, wire harnesses, cable assemblies and wiring assemblies. The number of conduits in such embodiments may be less than, the same as, or more than the number of electrical wires present in said electrical wire housing. Such embodiments are particularly advantageous as they allow fire-control material to be dispensed within electrical wire housings, whereas fire-control material in "flooding" systems cannot penetrate into such electrical wire housings.

In preferred embodiments there are multiple conduits, preferably in the form of pipes or needles, which may be flexible and/or deformable, and which include a plurality of perforations along at least a portion, and preferably a major portion, of their length. The multiple conduits preferably track or extend along at least a portion of at least one electrical wire and/or other electrical component within the device.

In embodiments, the at least one conduit is configured such that at least a portion of the electrical wiring and/or other electrical component is positioned within the at least one conduit. That is, the at least one conduit may be configured such that it at least partially surrounds or encapsulates the electrical wiring and/or other electrical component. At least a portion or substantially all of the electrical wires of the device/appliance may extend through at least one conduit. In some embodiments, at least some of the electrical wires of an appliance/device are surrounded along a major portion or their entire length by the at least one conduit. The at least one conduit may define a volume in which the at least a portion of the electrical wiring and/or other electrical component may be positioned, in use. In such embodiments the at least one conduit may comprise one or more apertures through which the fire-control material may be dispensed into the volume containing the electrical wiring and/or electrical component when the at least one heat and/or smoke sensor detects heat and/or smoke inside the housing. In other embodiments the electrical wiring and/or electrical component is positioned within a section of the conduit and the fire-retarding, fire-extinguishing or fire-prevention material is dispensed along at least a portion of the length of the conduit to the section of the conduit containing the electrical wiring and/or electrical component when the at least one heat and/or smoke sensor detects heat and/or smoke inside the housing.

The use of conduits to dispense fire-control material is also advantageous as it allows the material to be dispensed at multiple locations within a device/appliance substantially simultaneously and enables the material to reach hard-to-reach or critical areas (such as circuit boards, electrical connecting blocks, embedded wires, wires in a wiring loom, wires hidden behind a façade, or wires in separate compartments), for example by arranging conduits to flow into these areas. This therefore mitigates or overcomes problems associated with "flooding" systems, as these systems do not dispense fire-control material efficiently throughout a whole device/appliance, or to critical/hard-to-reach areas of a device/appliance.

The smoke and/or heat sensors may be located inside and/or outside the housing. In embodiments the smoke and/or heat sensors may be positioned within, proximal to or otherwise associated with one or more electrical components of the device. In some embodiments the smoke and/or heat sensors are positioned within, proximal or otherwise associated with a circuit board, electrical connecting block, battery, plug pin, wire, relay, switch, circuit breaker, capacitor, transformer, electromagnet, electrical socket, and/or metal socket connector of the device. In some embodiments, the smoke and/or heat sensors are positioned within an electrical connecting block of the device. The sensors may be attached directly to the container and/or attached to the container by means of an ignition or electrical signal system. The ignition or electrical signal system may comprise wires.

The number of smoke sensors may be at least 1, at least 2, at least 3, at least 4, at least 5 or at least 10. The number of heat sensors may be at least 1, at least 2, at least 3, at least 4, at least 5 or at least 10.

In embodiments the smoke and/or heat sensors may be positioned within, proximal to or otherwise associated with the at least one conduit. There may be one or more smoke and/or heat sensors positioned at different locations along a length of the at least one conduit. In some embodiments there is provided a plurality of smoke and/or heat sensors positioned at respective locations along the length of the at least one conduit.

The electrical device may comprise a rupturable partition inside or outside the housing. The partition may separate the container from the housing, or in embodiments where the container is inside the housing, from a portion of the housing. The partition may be arranged to rupture and/or disintegrate upon explosion or rupture of the container and/or dispensing of the fire-control material from the container. The partition may be replaceable. The partition may comprise a membrane.

In other embodiments the container holding the fire-control material is outside the housing, and may be spaced apart from the housing, or abutting the housing. In some embodiments, the container outside the housing is in fluid connection with the inside of the housing by means of at least one pipe or conduit. In these embodiments, the refilling or the replacing of the container may be particularly easy as it may be located in an easy-to-access storage location. In any case, in such embodiments, the housing may not need to be opened to access the container or used container.

The fire-control material may be a liquefied gas. In some embodiments the liquefied gas may be liquid carbon dioxide or liquid nitrogen. Liquefied gas may be very cold and may have the advantage that the fire or electrical component is cooled very quickly upon dispensing of the fire-control material, which may prevent the electrical component from starting a fire per se.

The fire-control material may comprise a compressible material. The fire-control material may be selected from; gas, compressed gas, foam, compressed foam, or mixtures thereof. The gas may be carbon dioxide. In preferred embodiments, the fire-retarding material is a compressed gas. Compressed gas may be advantageous as once released by the container, it expands very quickly and therefore smothers the fire or starves a potential fire of oxygen rapidly, and also cools rapidly as it expands, thus cooling the fire and/or hot electrical component thereby increasing fire prevention and/or extinguishing efficiency.

In some embodiments, the fire-control material comprises a powder. The powder may be mixed with a propellent or expellant material to allow for efficient expulsion/dispensing of said powder.

In some embodiments, the system further comprises a gas sensor. The gas sensor may be arranged and/or may operate in a similar or identical way to the heat and/or smoke sensors as described herein.

The gas sensor may be arranged to detect gas outside the housing and/or electrical device/appliance. This may be particularly advantageous in embodiments comprising a light switch or power switch, where power can be cut off when gas is present in the surrounding environment (for example from a gas leak or a gas hob left on), thus removing the danger of creating a spark when the switch is pressed, which may otherwise have ignited the gas.

The electrical device may comprise an electrical appliance or may be selected from an electrical socket (such as an electrical plug socket, a power cord socket, phone socket, USB socket or the like, for example), a light switch, a power socket or a plug, for example. In such embodiments, the housing of the system may comprise the outer casing of the electrical device.

In some embodiments the device may be an electrical appliance selected from a plug, a mobile phone, a desktop computer a laptop computer, a tablet computer, a washing machine, a tumble dryer, a refrigerator, a freezer, a television, a hair dryer, an electrical kitchen implement or a video games console, for example.

In some embodiments, the electrical component may be a motor. In other embodiments the electrical component may be selected from a circuit board, electrical connecting block, battery, plug pin, wire, relay, switch, circuit breaker, capacitor, transformer, electromagnet, electrical socket, metal socket connector or the like, for example.

In some embodiments the housing comprises a plurality of electrical components. In particular, when the electrical device is an appliance the housing may comprise multiple electrical components, such as, for example, a motor and a circuit board.

Electrical components include electronic components.

In some embodiments, the housing comprises an inner wall and an outer wall. In such embodiments, the walls of the housing may be arranged to also act as the container. The inner and outer walls of the housing may define a container and/or may contain fire-control material. The housing walls may be refillable and/or replaceable. The housing walls may have space for wiring and/or conduits of the device, appliance and or system to run through, and the housing may be substantially air-tight. The walls of the housing (containing the fire-control material) may be arranged to dispense the fire-control material inwardly (into the cavity surrounded by the housing) upon receiving a signal from the at least one heat and/or smoke sensor. In preferred embodiments, the electrical component may be a motor. In especially preferred embodiments, the electrical component is a motor of an electrical appliance or device.

In some embodiments, the housing is substantially air-tight.

The housing may be openable and/or removable. This may assist in repair and/or maintenance of the system and/or electrical component and/or appliance/device.

In some embodiments, the electrical device further comprises a circuit breaker. The circuit breaker may be operably connected to the at least one heat and/or smoke sensor. The circuit breaker may be arranged to cut off supply of electricity to the electrical component and/or device when the smoke and/or heat sensors detect heat and/or smoke inside, or in the vicinity of, the housing. The circuit breaker may be arranged to cut off supply of electricity to the whole electrical appliance and/or device and/or to part of the device.

The electrical device may further comprise a data receiver and/or transmitter, operable to send data to and/or receive data from an external computing device. The external computing device may be selected from; a laptop computer, desktop computer, mobile phone, smart phone, tablet and personal digital assistant (PDA). The data receiver and/or transmitter may be a Bluetooth receiver and/or transmitter. The data receiver and/or transmitter may be a Wi-Fi receiver and/or transmitter. The data receiver and/or transmitter may send data (over Bluetooth and/or Wi-Fi/the internet) to the external computing device upon receipt of a signal from the at least one smoke and/or heat sensor. The data may comprise a warning and/or alert to a user or owner of the electrical device.

Devices of the invention may have a unique data signature. If multiple or many devices of the invention are being used in one particular area, the uniquely identifiable data from a particular device may allow quick identification of one device. This is useful for identifying which device tripped and so finding the potential danger and/or expended/used device faster. This will aid in the quicker location and/or prevention of a fire or potential fire and/or the quicker identification and/or location of a device which needs fixing, refilling or replacing, where more than one device is in use.

Such embodiments may be particularly advantageous as they may allow for alerting a homeowner to a fire or potential fire in their home, thus allowing them to return home to check the problem, or to call the fire department to investigate. Such devices may also be directly connected, for example, to an external computing device at a local fire station. This could allow firefighters to respond to a fire or potential fire very quickly, as it would not need a "middle man", such as a homeowner or a bystander, to call the fire service; an event which requires a fire to first be noticed by someone or to be detected by known smoke alarms, and hence to have already started and/or to be sufficiently large. Therefore, the time from a fire starting to the firefighters arriving may be reduced.

In especially preferred embodiments, the automatic fire prevention or extinguishing system dispenses the fire-control material into the housing and/or onto the electrical component when the at least one heat and/or smoke sensor detects heat and/or smoke inside the housing, and also, at substantially the same time, cuts electricity off to the whole electrical device and/or to the electrical component, and sends a signal from the data receiver and/or transmitter to an external computing device.

Such embodiments are particularly advantageous as they allow the substantially simultaneous and automatic removal or cutting off of electricity (the source of the problem), extinguishing and/or preventing the fire, and alerting someone to the fire by means of a signal sent to a computing device, such as a mobile phone or desktop computer.

The heat and/or smoke and/or gas sensors, the circuit breaker, the container holding the fire-retarding material, the ignition system, the electrical signaling system and the data receiver and/or transmitter may (separately or combined) have indicator/warning/alert lights and/or sound alarms associated with them. The indicator/warning/alert lights and/or sound alarms may trigger or activate when the corresponding component is activated. The indicator/warning/alert lights and/or sound alarms may be arranged on the housing and/or on the outside of the electrical device. The indicator/warning/alert lights and/or sound alarms associated with the heat and/or smoke and/or gas sensors may have graduated responses, such as varying volumes of sound and/or levels of and/or colours of light output, depending on the amount/strength/magnitude of the stimulus (for example, heat, smoke and/or gas) detected by the at least one sensor. These embodiments may allow a user in close proximity to the system to quickly be alerted when the system has been activated, and to determine which parts of the system have been activated and what the nature of the problem may be. Such embodiments may provide easy reference for anyone dealing with, using, looking at, repairing, maintaining, replacing and/or refilling the device.

The automatic fire prevention or extinguishing systems used in the invention may be retrofitted into existing devices. The automatic fire prevention or extinguishing systems may be incorporated into devices of the invention during manufacture and/or may be present as an integral part of the device.

Devices of the invention may be connected to other/external fire alarm and/or fire prevention and/or fire safety systems. Such fire prevention systems may be sprinkler systems.

Devices of the invention may have a back-up battery.

According to a second aspect of the invention, there is provided the use of an automatic fire prevention or extinguishing system of the first aspect of the invention to prevent or extinguish a fire.

According to a third aspect of the invention, there is provided a kit comprising:

a) an electrical device comprising a housing containing at least one electrical component; and b) an automatic fire prevention or extinguishing system comprising a container holding a fire-retarding, fire-extinguishing or fire-prevention material, and at least one heat and/or smoke sensor operably connected to the container, and at least one conduit operably connected to the container, through which the fire-retarding, fire extinguishing or fire-prevention material is disposed, in use, the or each conduit being arranged to track electrical wiring of the electrical device or track at least part of an outer surface of at least one electrical component of the device.

According to a fourth aspect of the invention, there is provided a method of preventing, retarding or extinguishing a fire using an electrical device of the first aspect of the invention, comprising the steps of; (a) detecting smoke and/or heat in the housing with the at least one smoke and/or heat sensor; (b) automatically sending a signal from the at least one heat and/or smoke sensor to the container holding the fire-retarding, fire-extinguishing or fire-prevention material; and (c) automatically dispensing the fire-retarding, fire-extinguishing or fire-prevention material into the housing in response to the signal from the at least one heat and/or smoke sensor.

The method may further comprise the step of; automatically sending data from a data receiver and/or transmitter to an external computing device. The external computing device may be selected from; a laptop computer, desktop computer, mobile phone, smart phone, tablet and personal digital assistant (PDA). The data receiver and/or transmitter may be a Bluetooth™ receiver and/or transmitter. The data receiver and/or transmitter may be a Wi-Fi receiver and/or transmitter.

In some embodiments, the method may further comprise the step of automatic activation of a circuit breaker to cut off the supply of electricity to the electrical component and/or to the whole electrical device and/or appliance that said electrical component belongs to.

DETAILED DESCRIPTION OF THE INVENTION

In order that the invention may be more clearly understood one or more embodiments thereof will now be described, by way of example only, with reference to the accompanying drawings, of which:

Figure 1:
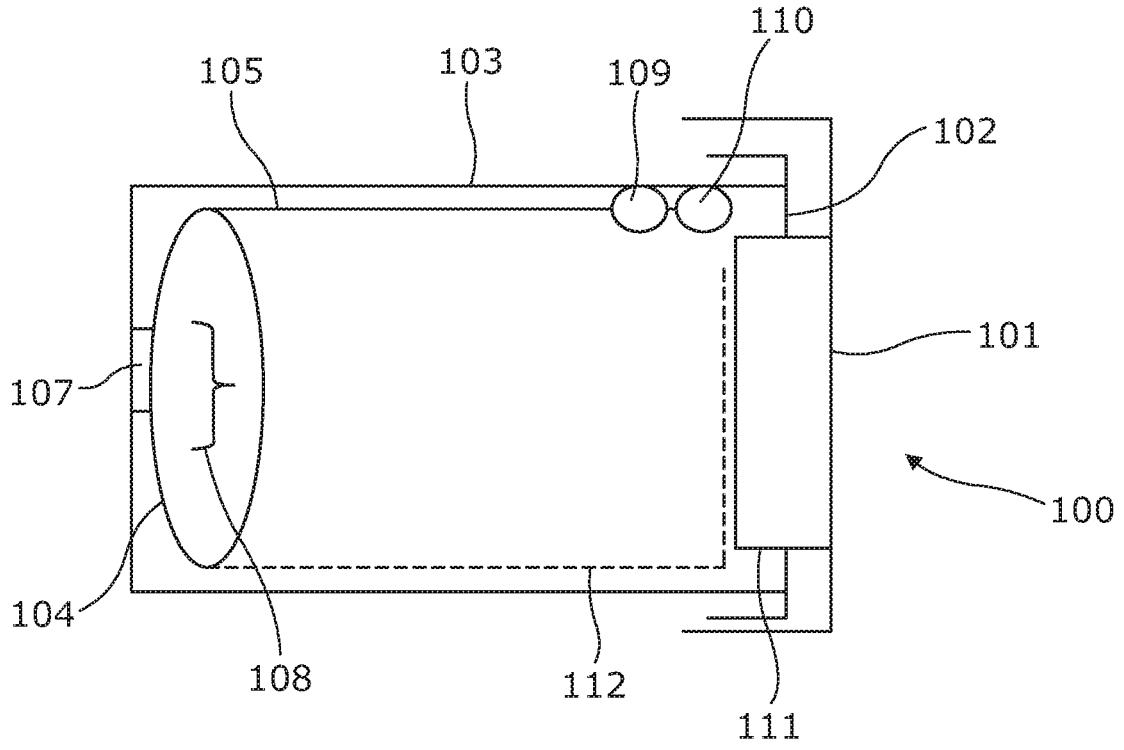
FIG. 1 illustrates a side sectional view of a first embodiment of a device of the invention in the form of a plug socket.

Referring firstly to FIG. 1, an embodiment of a device of the invention in the form of a plug socket 100, comprises a plug socket front housing 101 connected to fire-proof gasket 102. Fire-proof gasket 102 is connected to a back housing in the form of a back box 103, forming a substantially air-tight seal. The plug socket front housing 101 comprises a plug socket face plate 111. The plug socket face plate 111 includes electrical components in the form of electrical contact pins and associated wiring (not shown). At the back of back box 103 is located a container in the form of canister 104, which contains a fire prevention and extinguishing material in the form of compressed carbon dioxide gas. The canister 104 is mounted on the back box 103 by a bracket 107. The canister 104 further comprises a release valve 108, and is connected to a conduit 112. The conduit 112 runs along the bottom of back box 103 and then along the back of the plug socket face plate 111 and is perforated by multiple apertures in multiple locations along its length. Located at the front end of back box 103, close to and substantially above, plug socket face plate 111, are a smoke sensor 109 and a heat sensor 110. Smoke sensor 109 and heat sensor 110 are connected to a signaling system 105. Signaling system 105 is made of wires which run along the top of back box 103 to canister 104.

The use of plug socket 100 will now be described with reference to FIG. 1. When sufficient levels of heat and/or smoke are given off by a fire (or the beginnings of a fire) or by the electrical component(s) inside the housing (the housing is the space enclosed by back box 103 and the face plate 101 and/or fire-proof gasket 102), heat sensor 110 and/or smoke sensor 109 detect said heat and/or smoke and send a signal through the wiring of the signaling system 105 to the release valve 108 of the container 104. This signal causes release valve 108 to be activated, thus the compressed carbon dioxide in canister 104 is expelled into the conduit 112. The carbon dioxide expands rapidly and so moves along the entire length of conduit 112. Carbon dioxide is thus expelled out of the perforations along the length of conduit 112 into the housing, and it rapidly expands to fill the housing (formed by the back box 103 and front housing 101) while also cooling significantly due to said expansion. The fire or potential fire is therefore smothered in carbon dioxide, thus depriving it of oxygen, and the interior of the housing and its electrical components are simultaneously cooled, thereby extinguishing any fire or preventing a potential fire from starting. Carbon dioxide efficiently reaches all areas of the housing due to being dispensed in multiple locations within the housing, substantially simultaneously (effected by the perforations along conduit 112). Canister 104 can be refilled in order for the invention to be reset ready for subsequent use. In some examples, the canister 104 may not comprise conduit 112, and may be arranged or constructed to dispense the carbon dioxide by exploding or rupturing, such as through activation by an ignition system, and in these cases, may be replaceable.

Figure 2:
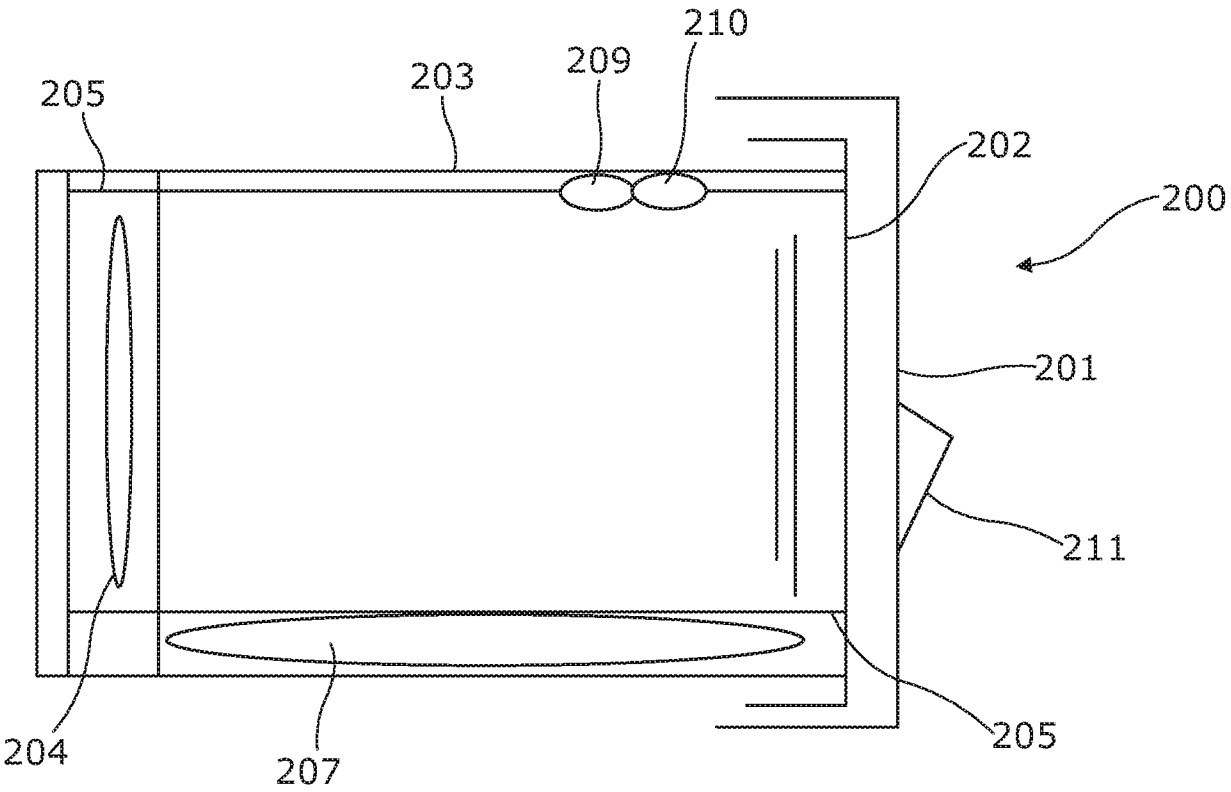
FIG. 2 illustrates a side sectional view of a device not of the invention in the form of a wall switch.

FIG. 2 shows a device not of the invention in the form of a wall switch 200. The wall switch 200 comprises a front housing in the form of a face plate 201, a fire proof gasket 202, a rear housing in the form of a back box 203, a first canister 204 filled with compressed carbon dioxide, a smoke sensor 209, a heat sensor 210, all of which are as substantially described above for the embodiment of FIG. 1. The wall switch 200 comprises a number of differences to the plug socket 100 of FIG. 1, namely; there is an extra carbon dioxide canister 207 inside, and adjacent to the bottom face of, the back box 203; there is an ignition system 205 in place of a signaling system (also comprised of wires), which runs along the perimeter of canister 204 and second canister 207; includes a light switch 211 connected to the face plate 201 in place of a plug socket; lacks a carbon dioxide conduit (112 in FIG. 1), instead having canisters 204 and 207 which comprise a frangible material arranged to rupture and/or explode upon activation by the ignition system 205, when a signal is sent by the smoke sensor 209 and/or heat sensor 210. The canisters 204 and 207 may also be mounted on a bracket, as in the embodiment of FIG. 1.

Light switch 200 functions in essentially the same way as described for plug socket 100 with the following key differences; when a signal is sent from smoke sensor 209 and/or heat sensor 210, instead of causing release of carbon dioxide through a perforated conduit, it causes canisters 204 and 207 to rupture and/or explode, thereby releasing their contents of carbon dioxide, which floods the housing formed by the front plate 201, gasket 202 and back box 203. Light switch 200 may also comprise a membrane which separates canisters 204 and 207 from the rest of the housing, arranged to be ruptured and/or disintegrated either directly by the ignition system, or by the rapidly expanding carbon dioxide gas.

Figure 3:
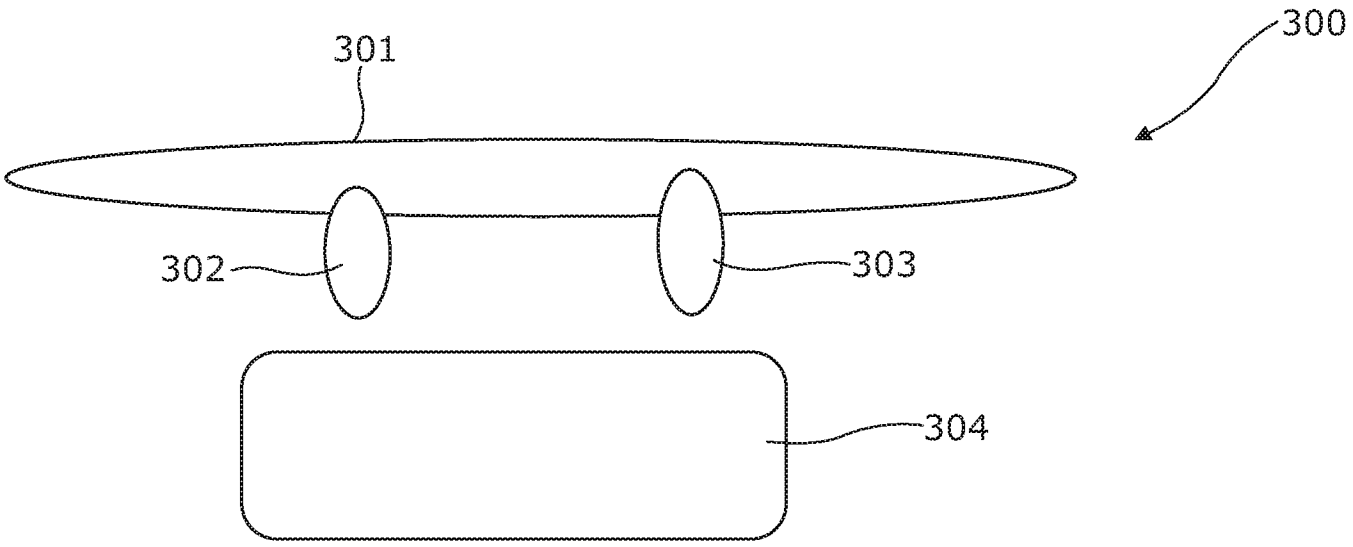
FIG. 3 illustrates a side sectional view of an automatic fire prevention or extinguishing system of a device not of the invention adjacent to an appliance motor.

FIG. 3 shows a side cross-sectional view of an automatic fire prevention or extinguishing system 300 not of the invention adjacent to an appliance motor 304 of an electrical device of the invention. In this example the housing of the electrical device is not shown but is the casing of the electrical device, which may be an appliance such as a washing machine, tumble dryer or the like, for example and thus the motor 304 is a motor of the appliance. The system 300 further includes a canister 301 (containing compressed carbon dioxide) which is located above said motor 304. Attached to the underside of canister 301 is heat sensor 302 and smoke sensor 303. The sensors may alternatively be spaced apart from canister 301 and connected by means of, for example, wires. Other components such as the housing and electrical wiring are not shown.

In use, when motor 304 is on fire or starts to smoke or give off significant heat, this is detected by smoke sensor 303 and/or heat sensor 302, which sends a signal to canister 301. Canister 301 then dispenses/releases compressed carbon dioxide which is directed directly onto motor 304. The fire or potential fire is thus rapidly starved of oxygen by the rapidly-expanding carbon dioxide and is also cooled rapidly by the expanding carbon dioxide. The fire or potential fire is thus rapidly and efficiently prevented and/or extinguished. Canister 301 can then be refilled so as to reset the system ready for subsequent use.

Figure 4:
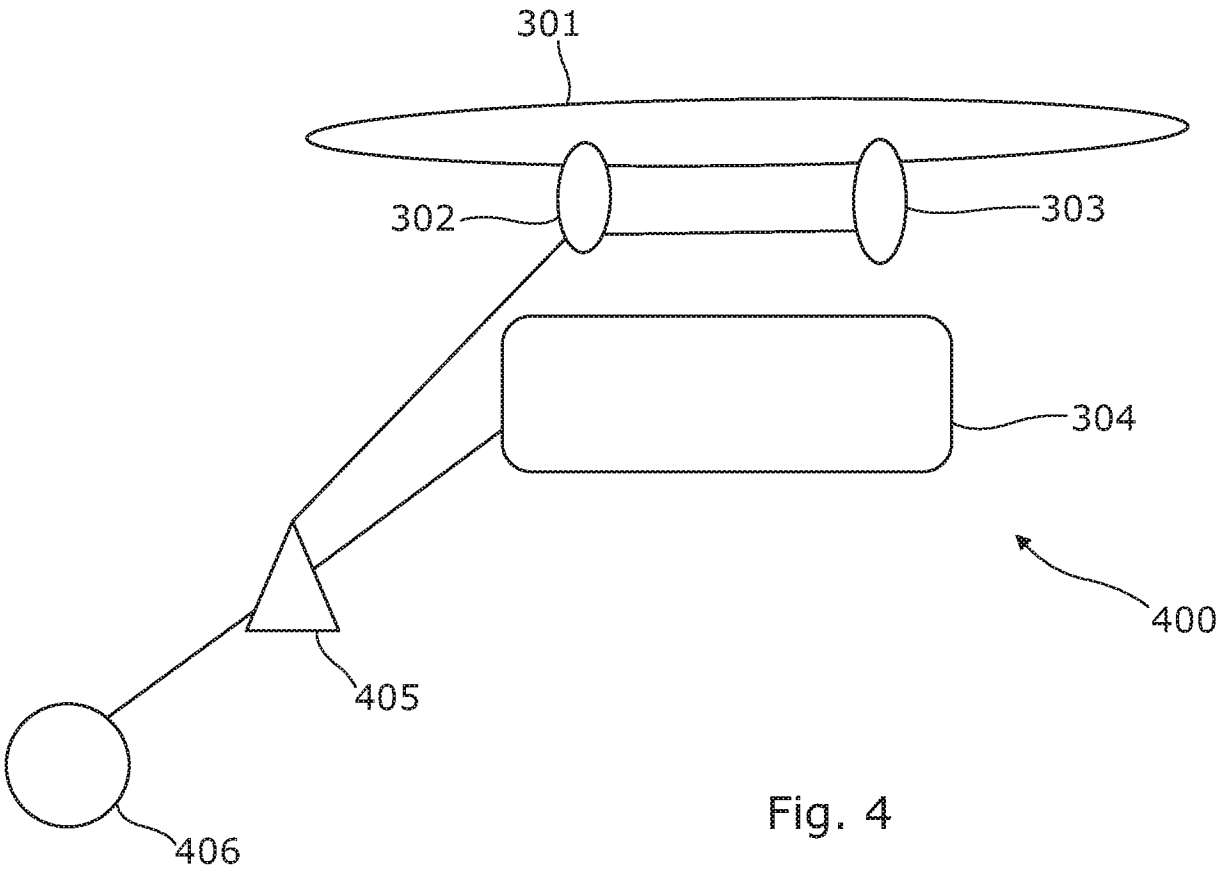
FIG. 4 illustrates a side sectional view of the automatic fire prevention or extinguishing system of FIG. 3, further comprising a circuit breaker.

FIG. 4 illustrates a further automatic fire prevention or extinguishing system 400 not of the invention further comprising a circuit breaker 405. System 400 is structurally the same as system 300 of FIG. 3 and like numerals represent like components, but further comprises circuit breaker 405 and plug 406. Plug 406 and circuit breaker 405 are wired to each other, and circuit breaker 405 is wired to motor 304, such that motor 304 receives an external supply of electricity, for example from a mains supply. In other examples, the power supply is not limited to mains power, but may be, for example, a battery. In such examples, there may be no plug 406 present/needed.

In use, when a fire or potential fire occurs in or on motor 304, smoke sensor 303 and/or heat sensor 302 detect the heat and/or smoke and the system proceeds to automatically prevent and/or extinguish the fire as described hereinabove for system 300. In system 400, smoke sensor 303 and/or heat sensor 302 also send a signal to circuit breaker 405 when activated. Circuit breaker 405 then breaks the circuit between the power supply into which the plug is inserted, and the motor 304, thus cutting off supply of electricity to motor 304. In this way, reoccurrence or persistence of a fire can be at least partially mitigated. This also allows for a person to more safely access the inside of the system, without risk of electrocution. Circuit breaker 405 can also be arranged to cut off electricity supply to the entire device in which motor 304 is located, as opposed to just to the motor 304.

Figure 5:
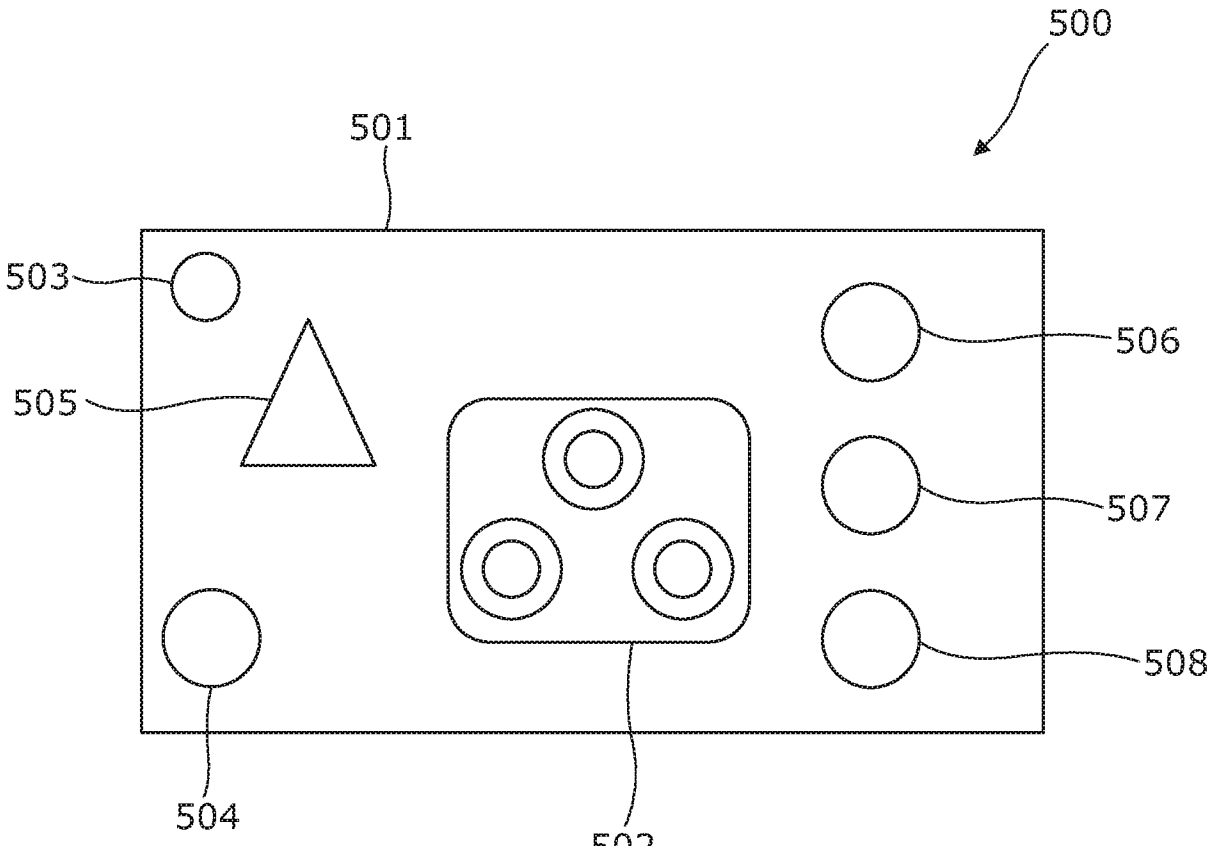
FIG. 5 illustrates a front view of a second embodiment of a device of the invention in the form of a plug socket.

A front view of an embodiment of an electrical device of the invention in the form of a plug socket 500 is shown in FIG. 5. The socket 500 includes a housing (not shown) in the form of a back box similar to that described for the plug socket 100 of FIG. 1 and includes heat and smoke sensors, connected to an ignition or signaling system which in turn is connected to a container of compressed carbon dioxide gas. The socket 500 comprises a face plate 501 on/in to which various components are arranged. In the centre is a standard 3-pin plug socket 502 for receiving a 3-pin plug. In addition, the 3-pin plug socket 502 includes electrical components in the form of electrical contacts and associated wiring. 3-pin plug socket 502 may be replaced with any means of wiring into a power supply, for example plugs/plug sockets from other countries or regions. Arranged vertically on the right of socket 502 are, from top to bottom; smoke/carbon monoxide sensor warning light 506, gas sensor 507 and heat sensor warning light 508. In the top left corner of face plate 501 is a "$CO_2$ deployed" indicator 503 electrically connected to the container of $CO_2$ within the device 500. In the bottom left corner of the face plate 501 is a Bluetooth receiver/transmitter 504. Bluetooth receiver/transmitter 504 can be replaced by a Wi-Fi receiver/transmitter. To the left of socket 502 is circuit breaker warning light 505, electrically connected to a circuit breaker, which in turn is connected to the heat, smoke and/or gas sensors of the device.

In use, when the smoke and/or heat sensors (not shown) have been triggered, this will cause smoke sensor warning light 506 and/or heat sensor warning light 508 to light up. Heat sensor warning light 508 may show graduated intensities of light, or different colours of light, depending on the amount/strength/magnitude of heat detected. Upon receipt of a signal from the smoke and/or heat sensor, carbon dioxide (or another fire-retarding material) will be dispensed from the canister in the back box (not shown) as described hereinabove for other embodiments and examples. The "$CO_2$ deployed" indicator 503 is then activated and lights up (or it may emit a sound, or both). Any of the indicators/warning lights mentioned may be replaced or combined with a sound alarm that triggers at the same time as the indicator/warning light. Simultaneously, the circuit breaker (not shown) and the Bluetooth receiver/transmitter 504 will be activated and perform their function as described hereinabove for other embodiments and examples. The circuit breaker warning light 505 is activated upon activation of the circuit breaker. Gas sensor 507 is arranged to detect gas outside the housing (i.e. in the surrounding environment) and is electrically connected to the circuit breaker, so as to cut off electricity when gas is detected. The gas sensor 507 may also be associated with a further warning light and/or a sound alarm. In some embodiments, the gas sensor may also be arranged to detect gas inside the housing and/or a device/appliance (for example in an appliance using gas and electricity, such as a boiler).

The warning/alert lights and/or sound alarms provide easy reference for anyone dealing with, using, looking at, repairing, replacing and/or refilling the device.

Figure 6:
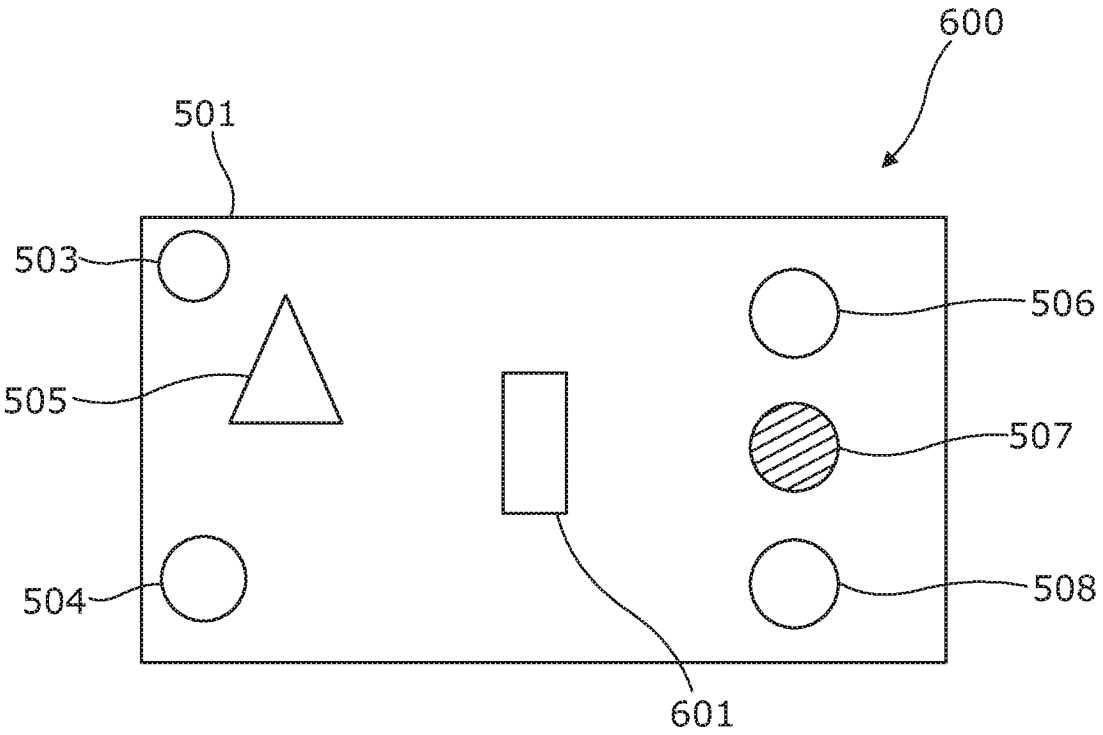
FIG. 6 illustrates a front view of a third embodiment of a device of the invention in the form of a light switch.

Plug socket 500 may be modified to be a light switch or a general power socket switch. FIG. 6 shows an embodiment of a device of the invention in the form of a light switch box 600, wherein the essential difference from socket 500 of the embodiment of FIG. 5 is that the 3-pin plug socket 502 has been replaced with a light switch 601. Light switch 600 comprises a face plate 501 on/in to which various components are arranged. In the centre is light switch 601. Arranged vertically on the right of light switch 601 are, from top to bottom; smoke/carbon monoxide sensor warning light 506, gas sensor 507 and heat sensor warning light 508. In the top left corner of face plate 501 is a "$CO_2$ deployed" indicator 503 electrically connected to the container of $CO_2$ within the device 600. In the bottom left corner of the face plate 501 is a Bluetooth receiver/transmitter 504. Bluetooth receiver/transmitter 504 can be replaced by a Wi-Fi receiver/transmitter. To the left of light switch 601 is circuit breaker warning light 505. Light switch 600 works in essentially the same way as described hereinabove for plug socket 500.

Figure 7:
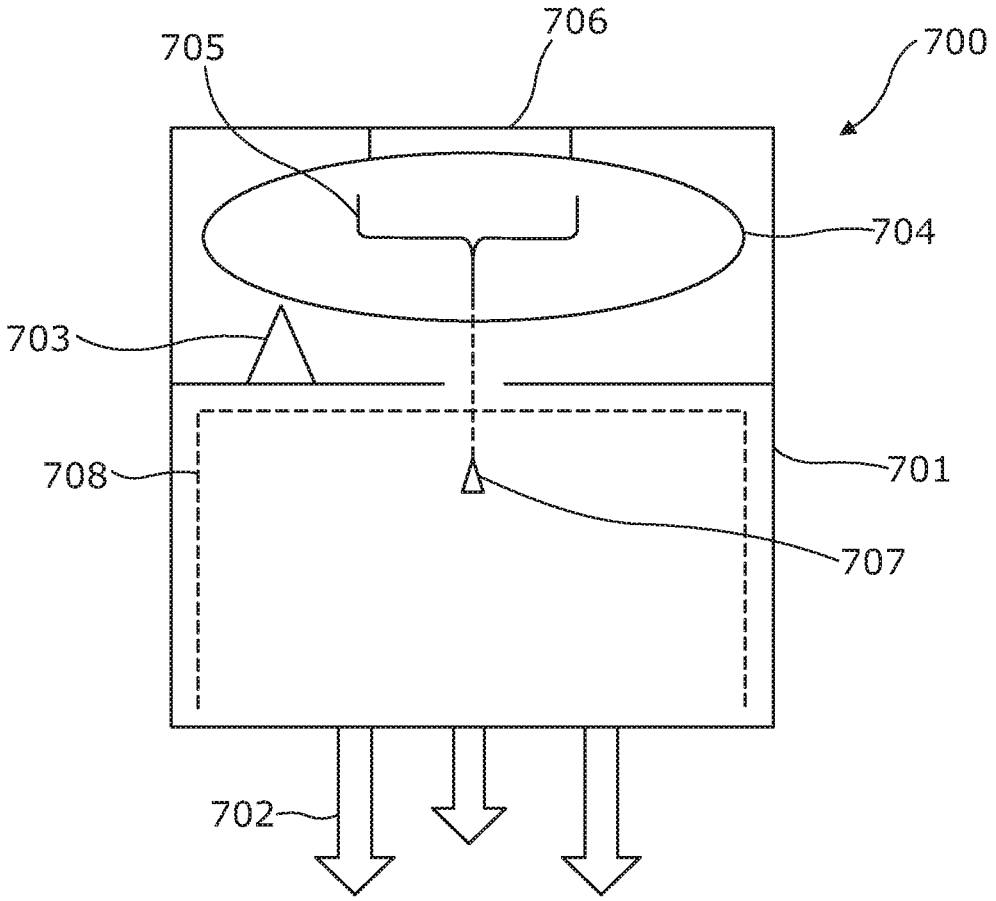
FIG. 7 illustrates a top view of a fourth embodiment of a device of the invention in the form of an electricity plug.

FIG. 7 illustrates a top view of an embodiment of an electrical device of the invention in the form of an electricity plug 700. Plug 700 comprises plug housing 701 with 3 plug pins 702 protruding from the front face (the lower side of plug housing 701 in FIG. 7). Mounted on the back of plug housing 701 by a bracket 706 is a canister 704, which contains compressed carbon dioxide gas. Canister 704 further comprises a release valve 705, and is connected to a conduit network 708. Conduit network 708 comprises a single branched conduit perforated along its length. At one terminal end of the conduit network 708 is nozzle 707. Plug housing 701 also comprises circuit breaker warning light 703, which is present and visible on the outside of plug housing 701 and is connected to a circuit breaker (not shown).

In use, when the system is activated by a signal from the smoke and/or heat sensor (not shown) as described hereinabove, release valve 705 activates and allows release of carbon dioxide from container 704 into the conduit network 708. Carbon dioxide thus rapidly expands and rushes through conduit network 708 and into plug housing 701, both through the multiple perforations in the branched conduit of the conduit network 708, and through the nozzle 707. Carbon dioxide is therefore dispensed in multiple locations within the housing 701, which allows substantially the entire interior volume of the housing 701 to be efficiently and rapidly filled with carbon dioxide gas. The expanding carbon dioxide gas thus rapidly starves the fire or potential fire of oxygen and rapidly cools/freezes it, therefore efficiently preventing and/or extinguishing the fire or potential fire. Substantially simultaneously, the circuit breaker (not shown) is activated and cuts off the flow of electricity through plug 700, which causes circuit breaker warning light 703 to activate/light up. Circuit breaker warning light 703 may be, or may be used alongside, a sound alarm. Features not shown in FIG. 7 but which are incorporated in the plug 700 are; a smoke sensor, a heat sensor and a circuit breaker. It should be appreciated that plug 700 may be modified using features present in other embodiments of the invention and examples as described herein (as is the case for all specific embodiments disclosed herein), such as by adding an extra container or canister and/or switching the canister and conduit network for a rupturable canister as described in the example of FIG. 2—an ignition system would also be introduced if the canisters were arranged to explode and/or rupture as in the example of FIG. 2. Indicators and/or warning/alert lights and/or a data receiver/transmitter may also be incorporated, which function as described hereinabove.

Figure 8:
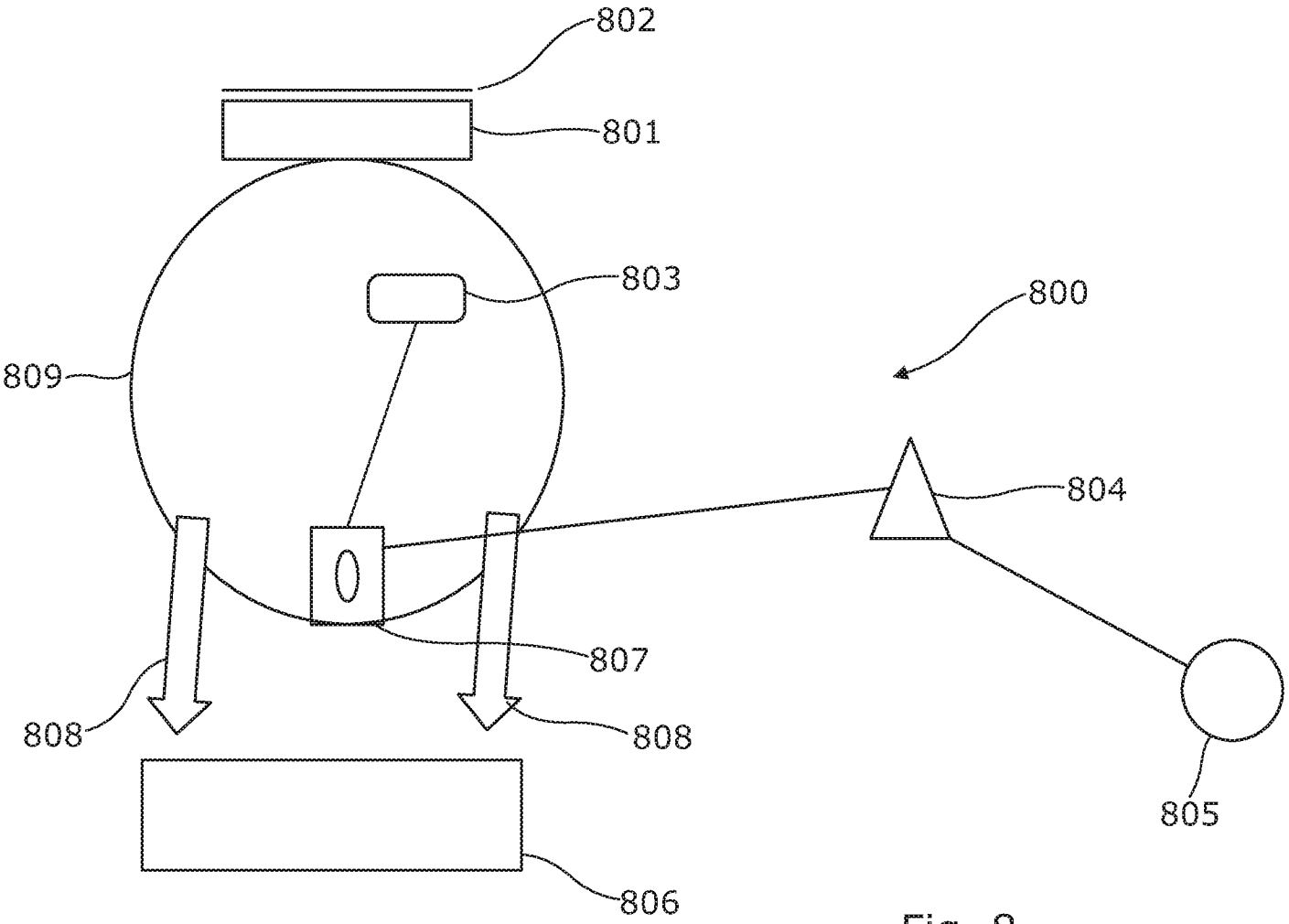
FIG. 8 illustrates a side cross-sectional view of a fifth embodiment of a device of the invention in which the automatic fire prevention or extinguishing system has been retrofitted to an appliance.

FIG. 8 illustrates a side cross-sectional view of an automatic fire prevention or extinguishing system 800 retrofitted to an appliance containing a motor 806, to form an electrical device of the invention. System 800 comprises a container 809 which holds compressed carbon dioxide and has been retrofitted into the appliance. Container 809 is bonded/fastened/secured to the appliance by means of an adhesive 802 which sticks a base 801 (which is itself secured to container 809) to the appliance. In other embodiments, adhesive 802 could be replaced by a different means of fastening, such as screws, rivets or the like. Container 809 further comprises smoke and heat sensors 807 wired to release valve 803. The sensors 807 are also wired to a circuit breaker 804, which is in turn wired to a plug 805. The system prevents and/or extinguishes a fire or a potential fire in essentially the same way as described hereinabove for previous embodiments and examples. Arrows 808 show the direction of carbon dioxide release upon activation of the system by the heat and/or smoke sensors, i.e. towards and smothering the motor 806.

Figure 9:
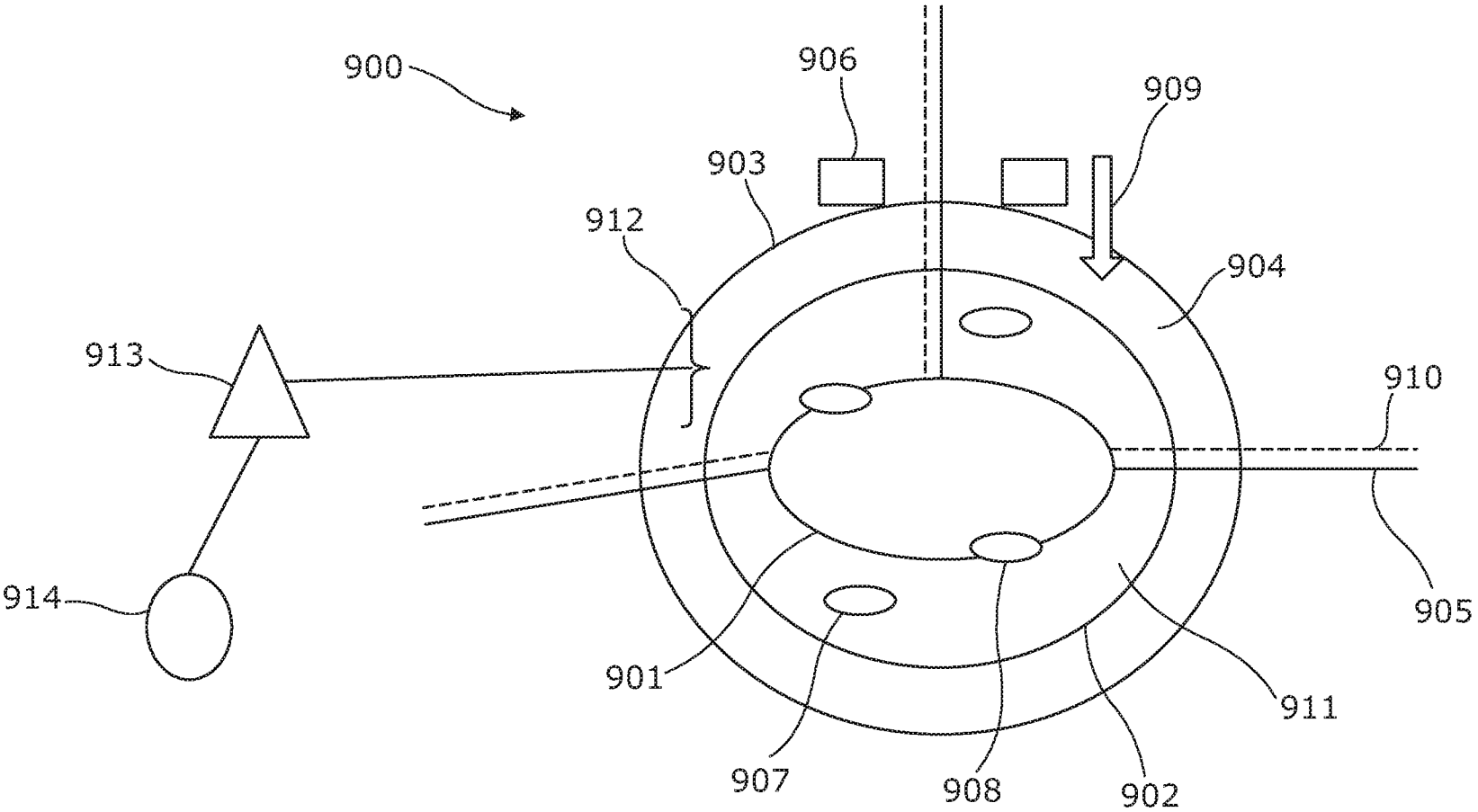
FIG. 9 illustrates a side sectional view of a sixth embodiment of a device of the invention comprising an automatic fire prevention or extinguishing system, comprising a fully integrated motor with carbon dioxide refill system.

FIG. 9 illustrates a side sectional view of another embodiment of an electrical device 900 of the invention, comprising a fully integrated motor with carbon dioxide refill system. The device 900 comprises appliance motor 901 enclosed within and entirely surrounded by casing membrane 902. Casing membrane 902 defines a housing interior space 911 in which motor 901 resides. Completely surrounding casing membrane 902 is an outer casing 903. Casing membrane 902 and outer casing 903 define a container 904, in which is stored compressed carbon dioxide. Container 904 is secured by bracket 906 and further comprises a refill nipple 909 and a release valve 912. Electrical wires 905 run through gaps in container 904 and stretch between the motor 901 and outside of the casing 904 and have associated wire-tracking carbon dioxide conduits 910 which follow the path of the electrical wires 905. Also inside the housing interior space 911 (i.e. the housing where the motor 901 is present) are heat sensors 907 and smoke sensors 908. Release valve 912 (connection shown), heat sensors 907 (connection not shown) and smoke sensors 908 (connection not shown) are electrically connected to circuit breaker 913, which is in turn electrically connected to plug 914. The electrical connections are in the form of wires.

In use, when the heat sensors 907 and/or smoke sensors 908 detect heat and or smoke coming from the motor 901, they send a signal to the release valve 912 of container 904, which activates release valve 912 and so allows compressed carbon dioxide gas to be dispensed inwardly onto the motor 901. The rapidly expanding carbon dioxide rapidly cools the motor and/or fire or potential fire and starves the fire or potential fire of oxygen, thus efficiently and quickly preventing and/or extinguishing it. Carbon dioxide may also be dispensed into other areas of the appliance in which the motor is located, through wire-tracking carbon dioxide conduits 910 (which may be and function substantially as described for the embodiments of FIG. 10, 11, 12 or 13) and/or additional carbon dioxide conduits (as described hereinabove and hereinbelow, not shown) that run throughout the rest of the appliance or to critical or desired areas of the appliance. Container 904 is able to be topped up or refilled with carbon dioxide by means of refill nipple 909. Circuit breaker 913 is also activated by the heat sensors 907 and/or smoke sensors 908 and cuts off electricity to the motor 901 and/or to the whole appliance in response to a signal from them. Circuit breaker 913 works in substantially the same way as described hereinabove for previous embodiments and examples.

Figure 10:
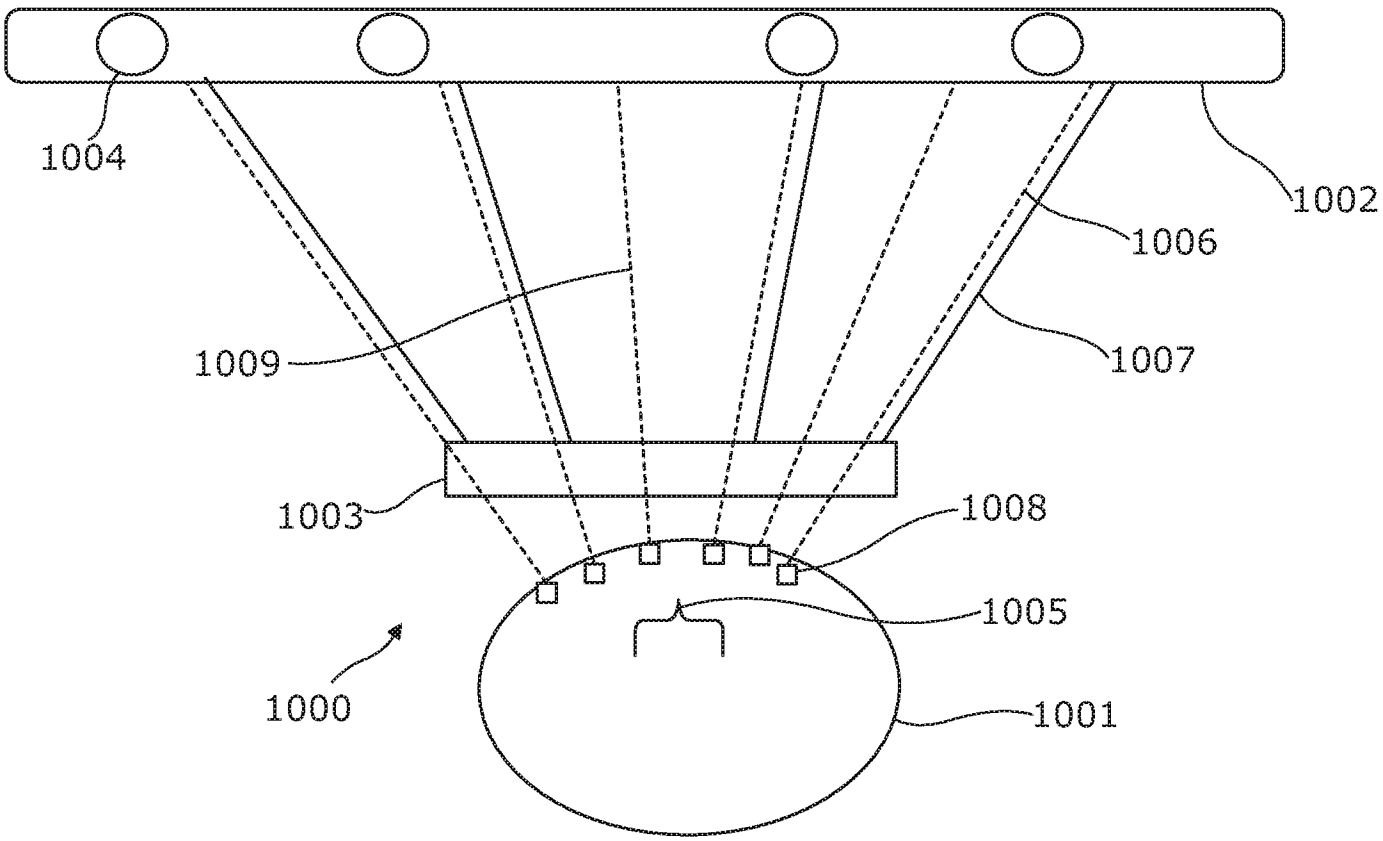
FIG. 10 illustrates a schematic view of an automatic fire prevention or extinguishing system of a seventh embodiment of a device of the invention comprising wire-tracking carbon dioxide conduits.

FIG. 10 illustrates a schematic view of an automatic fire prevention or extinguishing system 1000 of a seventh embodiment of a device of the invention comprising wire-tracking carbon dioxide conduits. System 1000 comprises an appliance 1002, a motor 1003 belonging to the appliance 1002, and a canister 1001 of compressed carbon dioxide gas. The appliance comprises heat and/or smoke sensors 1004 placed at multiple locations (for example in critical areas) within it and is electrically connected (by means of wires 1007—solid lines in FIG. 10) to motor 1003. Canister 1001 comprises release valve 1005 and is connected to carbon dioxide conduits 1009 and wire-tracking carbon dioxide conduits 1006 by means of conduit connectors 1008. Conduit connectors 1008 may be push or screw fit. Wire-tracking conduits 1006 follow the path of electrical wires 1007 in the device and may be present in/run through, for example, a wiring loom which contains said wires 1007 (see FIG. 13 for an example of a wiring loom of use in the invention). Conduits 1009 run to other areas of the appliance, for example areas where wires do not run into, and so would not be reached by wire-tracking conduits 1006.

The system prevents and/or extinguishes a fire or a potential fire in essentially the same way as described hereinabove for previous embodiments. When wires are present in a wiring loom, wire-tracking conduits 1006 are particularly advantageous as they may be able to extinguish or prevent a fire within said wiring looms, which previous systems may be unable to accomplish.

Figure 11:
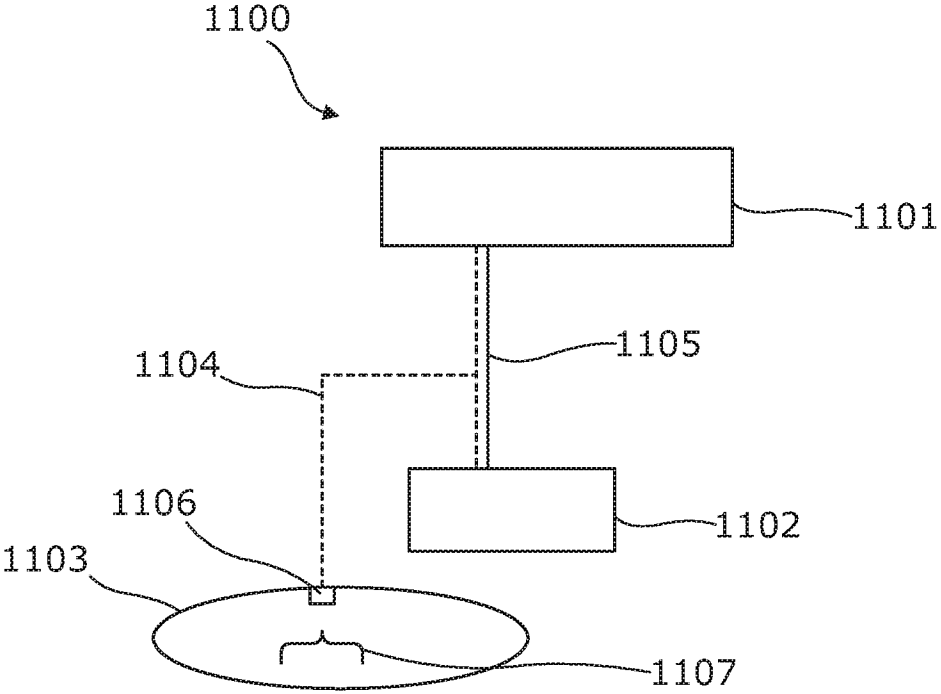
FIG. 11 illustrates a schematic view of an automatic fire prevention or extinguishing system of an eighth embodiment of a device of the invention comprising wire-tracking carbon dioxide conduits.

FIG. 11 illustrates a schematic view of an automatic fire prevention or extinguishing system 1100 of an eighth embodiment of a device of the invention comprising wire-tracking carbon dioxide conduits. System 1100 comprises; a compressed carbon dioxide canister 1103 connected to a conduit network 1104 (consisting of a single branched conduit) by means of conduit connector 1106; and an appliance 1101 electrically connected to an appliance motor 1102 by means of a wire 1105. Canister 1103 further comprises a release valve 1107. Conduit network 1104 runs from canister 1103 along a single path which branches into two paths when it meets the wire 1105, thereafter running as two distinct conduit paths in opposite directions along the wire 1105. One path runs into and around the appliance 1101 and one path runs into and around the appliance motor 1102.

The system prevents and/or extinguishes a fire or a potential fire in essentially the same way as described hereinabove for previous embodiments.

Figure 12:
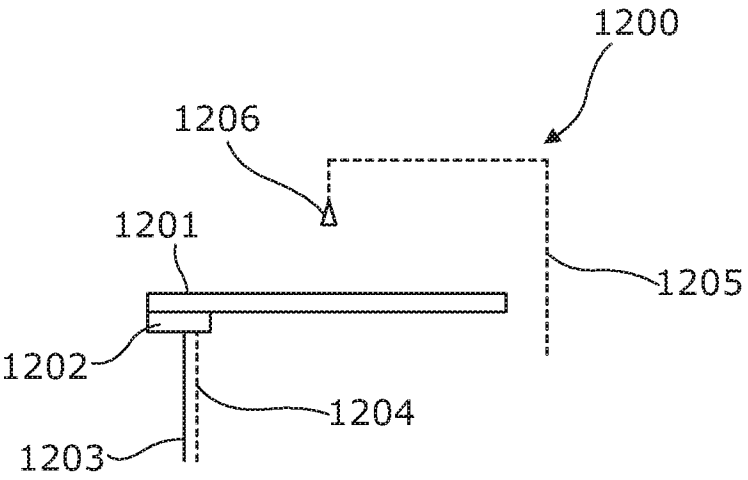
FIG. 12 illustrates a side sectional view of a portion of an automatic fire prevention or extinguishing system of a ninth embodiment of a device of the invention comprising a circuit board.

FIG. 12 illustrates a side sectional view of a portion of an automatic fire prevention or extinguishing system 1200 of an ninth embodiment of a device of the invention comprising a circuit board. System 1200 comprises a circuit board 1201 present inside an electrical appliance or device. Circuit board 1201 is wired to other parts of the device by means of wire 1203 connected to electrical connecting block 1202. The system further comprises wire-tracking conduit 1204 and conduit 1205. Conduit 1205 has a nozzle 1206 at its terminal end. Conduits 1204 and 1205 may be part of the same conduit network and are connected to other features of a fire extinguishing and/or prevention system of the invention as described hereinabove (for example, carbon dioxide canister, at least one smoke and/or heat sensor, release valve, circuit breaker, data transmitter/receiver).

The system prevents and/or extinguishes a fire or a potential fire in essentially the same way as described hereinabove for previous embodiments. Upon receipt of a signal from the at least one heat and/or smoke sensor, carbon dioxide is dispensed onto the circuit board 1201 through nozzle 1206, and substantially simultaneously into connecting block 1202 through conduit 1204.

Figure 13:
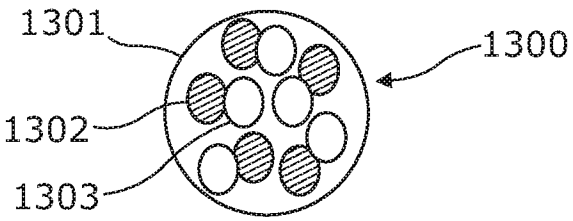
FIG. 13 illustrates a cross-section through a wiring loom of use in the invention.

FIG. 13 illustrates a cross-section through a wiring loom 1300 of use in the invention. The wiring loom 1300 comprises sleeve 1301, and multiple electrical wires 1302 and carbon dioxide conduits 1303. There is one conduit 1303 per wire 1302, however this may be changed such that there are a greater or fewer number of conduits 1303 than wires 1302. A wiring loom may be of use in embodiments with wire-tracking conduits, such as the embodiments of FIGS. 9, 10, 11 and 12.

Figure 14:
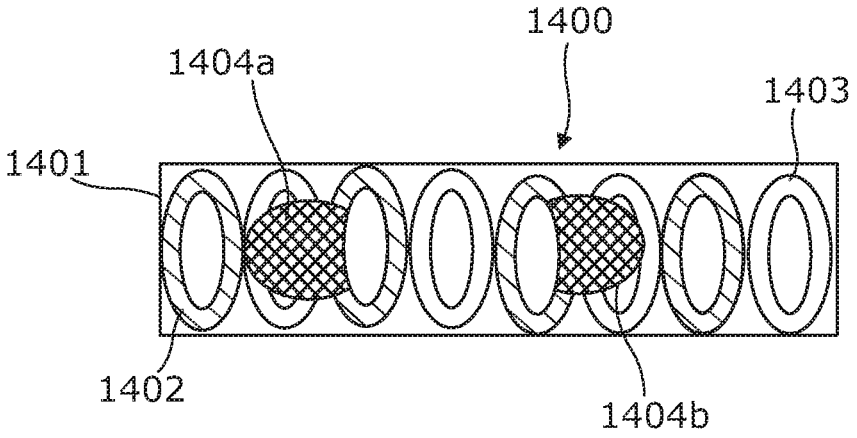
FIG. 14 illustrates a cross-section through an electrical connecting block of use in the invention.

FIG. 14 illustrates a cross-section through an electrical connecting block 1400 of use in the invention. The connecting block 1400 includes a housing 1401 and multiple electrical wires 1402 and carbon dioxide conduits 1403. As shown, there is provided one conduit 1403 per wire 1402 in an alternating arrangement across the connecting block 1400. In addition, there is provided sensors 1404*a*, 1404*b* positioned within the connecting block 1400 for detecting heat and/or smoke within the connecting block 1400. The sensors 1404*a*, 1404*b* are shown associated with respective pairs of wires 1402 and conduits 1403.

Figure 15:
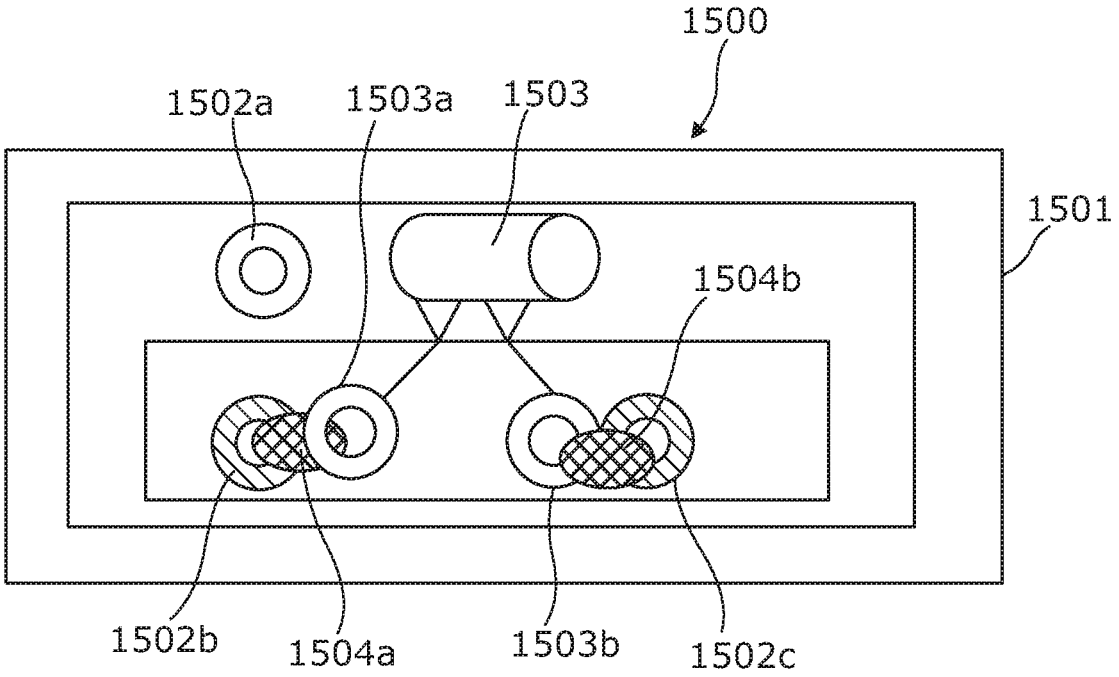
FIG. 15 illustrates a cross-section through an electrical socket of use in the invention.

FIG. 15 illustrates a cross-section through an electrical socket 1500 of use in the invention. The socket 1500 includes a housing 1501 and multiple electrical wires including an Earth wire 1502*a*, a Neutral wire 1502*b* and a Live wire 1502*c*. There is additionally provided carbon dioxide conduits 1503*a* and 1503*b* associated with the Neutral wire 1502*b* and the Live wire 1502*c*, respectively. In the illustrated embodiment, the conduits 1503*a*, 1503*b* comprise sub-conduits branching from a main conduit 1503 which may, for example, be fluidly connected to a container as described herein. In addition, there is provided sensors 1504*a*, 1504*b* positioned within the socket 1500 for detecting heat and/or smoke within the socket 1500. The sensors 1504*a*, 1504*b* are shown associated with respective pairs of wires 1502 and conduits 1503.

In the embodiments shown in the Figures and described herein, the (or each) conduit comprises multiple apertures along its length. However, it will be appreciated that the conduits may comprise none, one or many apertures as suitable for the system/device in which the invention is utilized. For example, and as described herein, the electrical wiring and/or electrical component may be positioned within a section of the conduit and the system may be arranged to control a flow of the fire control material along at least a portion of the length of the conduit to the section of the conduit containing the electrical wiring and/or electrical component. In embodiments having one or more apertures within the conduit, the (or each) aperture may be positioned at or proximal to the location of at least one electrical component and/or electrical connection point within the housing and/or the device.

Further, although not shown in the Figures, in embodiments at least a portion of the electrical wiring and/or other electrical component may be positioned inside the at least one conduit. The at least one conduit may define a volume in which the at least a portion of the electrical wiring and/or other electrical component may be positioned, in use and the at least one conduit may comprise one or more apertures through which the fire-control material may be dispensed into that volume. Alternatively, for example in embodiments where the at least one conduit does not comprise one or more apertures, the electrical wiring and/or electrical component may be positioned within a section of the conduit and the fire control material may be cause to flow along at least a portion of the length of the conduit to the section of the conduit containing the electrical wiring and/or electrical component.

The above embodiments are described by way of example only. Many variations are possible without departing from the scope of the invention, as defined in the appended claims.

The invention claimed is:

1. An electrical device comprising an electrical component housing, said housing having within:

at least one electrical component; and an automatic fire extinguishing system comprising:

at least one of: a heat sensor and a smoke sensor, said fire extinguishing system configured to: detect a presence of at least one of: a heat and a smoke; and generate a signal upon the detection of said presence of at least one of: said heat and said smoke;

a container holding a fire-control material;

at least one perorated conduit having at least one first terminal end operably connected to the container and at least one second terminal end positioned at or adjacent to the at least one electrical component of the device; and at least one non-perforated sleeve defining a volume through which is positioned the at least one perforated conduit and electrical wiring associated with said at least one electrical component, wherein said wiring is located outside of the at least one perforated conduit, and wherein said container is arranged to dispense the fire-control material through the at least one perforated conduit in response to said signal, and the at least one perforated conduit is configured to deliver the fire-control material to at least a part of said at least one electrical component through the at least one second terminal end of the at least one perforated conduit and to at least a portion of said electrical wiring associated with said at least one electrical component through at least one perforation positioned along the length of the at least one perforated conduit.

2. The electrical device as claimed in claim 1, wherein the at least one perforated conduit comprises at least one terminal aperture positioned at the second terminal end of said at least one perforated conduit.

3. The electrical device as claimed in claim 2, wherein the at least one terminal aperture is positioned at one of: at, and proximal to, the at least one electrical component.

4. The electrical device as claimed in claim 2, wherein said at least one terminal aperture is configured to dispense said fire control material on to an outer surface of said at least one electrical component.

5. The electrical device as claimed in claim 1, comprising a plurality of perforated conduits comprising a plurality of apertures along a length of each of said plurality of perforated conduits.

6. The electrical device as claimed in claim 1, wherein said electrical wiring is positioned within a section of the conduit, wherein said fire control material is dispensed along at least a portion of the length of said at least one perforated conduit to said section.

7. The electrical device as claimed in claim 1, wherein the fire-control material is selected from a group consisting of: a liquefied gas, a compressible material, a gas, a compressed gas, a foam, a compressed foam, and mixtures thereof.

8. The electrical device as claimed in claim 1, comprising a gas sensor.

9. The electrical device as claimed in claim 1, wherein the housing is one of a power socket housing, a plug socket housing, a light switch housing, and a plug housing.

10. The electrical device as claimed in claim 1, wherein said at least one electrical component is in an electrical appliance.

11. The electrical device as claimed in claim 1, wherein the at least one electrical component is a motor.

12. The electrical device as claimed in claim 1 comprising a circuit breaker configured to: cut off a supply of electricity to said electrical device in response to said signal.

13. The electrical device as claimed in claim 1, comprising at least one of a data receiver and a data transmitter, wherein said data receiver is configured to receive data from an external computing device; and said data transmitter is configured to transmit data to said external computing device.

14. The electrical device as claimed in claim 13, wherein the external computing device is selected from a group consisting of: a laptop computer, a desktop computer, a mobile phone, a smart phone, a tablet and a personal digital assistant (PDA).

15. The electrical device as claimed in claim 13, wherein the data receiver is one of a Bluetooth receiver and a Wi-Fi receiver; and said data transmitter is one of a Bluetooth transmitter and a Wi-Fi transmitter.

16. A fire suppression device to prevent or control or extinguish a fire within a housing containing at least one electrical component, said fire suppression device comprising:

at least one sensor selected from a group consisting of: a heat sensor configured to detect a presence of heat within said housing, a smoke sensor configured to detect a presence of smoke inside said housing, and a gas sensor configured to detect a presence of a gas outside said housing, wherein said at least one sensor is configured to generate a signal in response to said detection of at least one of: said heat, said smoke and said gas;

a container holding a fire control material;

at least one perforated conduit having at least one first terminal end operably connected to said container and at least one second terminal end positioned at or adjacent to the at least one electrical component; and at least one non-perforated sleeve defining a volume through which is positioned the at least one perforated conduit and electrical wiring associated with said at least one electrical component, wherein said wiring is located outside of the at least one perforated conduit, and wherein said container is arranged to dispense the fire-control material through the at least one perforated conduit in response to said signal, and the at least one perforated conduit is configured to deliver the fire-control material to at least a part of said at least one electrical component through the at least one second terminal end of the at least one perforated conduit and to at least a portion of said electrical wiring associated with said at least one electrical component through at least one perforation positioned along the length of the at least one perforated conduit.

17. A kit comprising:

an electrical device comprising:

a electrical component housing, said housing comprising within it:

at least one electrical component; and an automatic fire suppression system comprising:

a container holding a fire-control material;

at least one of: a heat sensor and a smoke sensor;

at least one perforated conduit having at least one first terminal end operably connected to the container and at least one second terminal end positioned at or adjacent to the at least one electrical component; and at least one non-perforated sleeve defining a volume through which is positioned the at least one perforated conduit and electrical wiring associated with said at least one electrical component, wherein said wiring is located outside of the at least one perforated conduit, and wherein said container is arranged to dispense the fire-control material through the at least one perforated conduit in response to said signal, and the at least one perforated conduit is configured to deliver the fire-control material to at least a part of said at least one electrical component through the at least one second terminal end of the at least one perforated conduit and to at least a portion of said electrical wiring associated with said at least one electrical component through at least one perforation positioned along the length of the at least one perforated conduit.

* * * * *